US006935235B2

(12) United States Patent
Pitz

(10) Patent No.: US 6,935,235 B2
(45) Date of Patent: Aug. 30, 2005

(54) PRINTING METHOD AND DEVICE

(75) Inventor: Heiner Pitz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 51 days.

(21) Appl. No.: 10/154,601

(22) Filed: May 23, 2002

(65) Prior Publication Data

US 2002/0176940 A1 Nov. 28, 2002

(30) Foreign Application Priority Data

May 23, 2001 (DE) ..... 101 25 545

(51) Int. Cl.[7] ..... B41N 6/00

(52) U.S. Cl. ..... 101/401.1; 101/466; 101/467; 430/301

(58) Field of Search ..... 101/401.1, 463.1, 101/465, 466, 467; 430/138, 300, 307

(56) References Cited

U.S. PATENT DOCUMENTS

| | | | | |
|---|---|---|---|---|
| 3,213,787 A | | 10/1965 | Miller | |
| 3,368,483 A | | 2/1968 | Storms | |
| 3,426,679 A | | 2/1969 | Rhines | |
| 4,248,959 A | * | 2/1981 | Jeffers et al. | 430/300 |
| 5,191,834 A | | 3/1993 | Fuhrmann et al. | |
| 5,324,617 A | * | 6/1994 | Majima et al. | 430/138 |
| 6,089,853 A | | 7/2000 | Biebuyck et al. | |
| 6,096,386 A | | 8/2000 | Biebuyck et al. | |

FOREIGN PATENT DOCUMENTS

| | | |
|---|---|---|
| DE | 3731835 A1 | 3/1989 |
| DE | 3835091 C2 | 6/1991 |
| DE | 19830491 A1 | 5/1999 |
| EP | 0 363 932 A2 | 4/1990 |
| EP | 0784543 B1 | 7/1997 |
| EP | 0 911 154 A1 | 4/1999 |
| GB | 1 370 659 | 10/1974 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A method for applying printing ink to a printing material, includes producing ink-conducting and ink-repelling areas on an at least approximately flat surface. A plurality of areas with defined color acceptor properties are provided to produce the ink-conducting areas on the surface. The surface is brought into contact with color particles, including a subgroup of dyes, pigments, colored molecules or colored particles. At least one of the subgroups colored molecules and pigments has surface acceptor properties corresponding to the color acceptor properties of the areas. The at least one subgroup colored molecules and pigments is deposited on the areas of defined color acceptor properties of the surface corresponding to the surface acceptor property. The at least one deposited subgroup colored molecules and pigments is transferred from the surface to a printing material. A printing form, an inking unit and a printing machine are also provided.

12 Claims, 3 Drawing Sheets

PRINTING METHOD AND DEVICE

BACKGROUND OF THE INVENTION

Field of the Invention

The invention relates to a method of applying printing ink to a printing material, wherein ink-conducting and ink-repelling areas are produced on an at least approximately flat surface, and to a printing form having an at least approximately flat surface with ink-conducting and ink-repelling areas.

Lithographic printing is based upon using the immiscibility of oil and water on the printing form, the lipophilic solution or the ink or color being firmly retained by the image-forming areas, and the water or the hydrophilic solution being held firmly by the non-image-forming areas of the printing surface. If the printing surface prepared in a suitable manner is wetted with a hydrophilic and lipophilic substance or solution, in particular, water and ink or color, the non-imaging areas then preferably retain the hydrophilic substance or solution and repel the lipophilic substances, while the imaging areas accept the lipophilic solution or ink or color and repel the hydrophilic substances. As a result, the lipophilic substance is then transferred in a suitable manner to the surface of a material on which the image is to be fixed, for example paper, material, polymers or the like.

For many years, aluminum has been used as the carrier material for printing plates. The aluminum is normally first subjected to a graining process and then to a subsequent anodizing process. The anodizing serves for providing an anodic oxide layer, the adhesion of which is improved by the graining. As a result of the graining, the hydrophilic properties of the background of the printing plate are reinforced. In the anodizing process, a powerful acid, such as sulfuric acid or phosphoric acid is normally used in order to make the surface subsequently hydrophilic by a further process, such as in a thermal silicizing process or so-called electrosilicizing.

In order to produce a printing form such as is described hereinabove, a large number of radiation-sensitive materials have become known which are suitable for generating images when the lithographic printing process is used, to the extent that, following exposure and, if necessary, requisite development and fixing, they provide an imaging area which can be used for printing. For example, photopolymerizable substances can be used for this purpose.

The aforedescribed arrangement is subjected to exposure in accordance with an image, in that energy is supplied selectively. This can be carried out, for example, by exposure through a mask using UV light, or else by direct writing with a laser.

The lithographic printing plates of the hereinafore-described type are normally treated with a developer solution, which is typically an aqueous alkaline solution with organic additives. The necessity for using and disposing of considerable quantities of these substances has for a long time been a particular problem in the use of printing processes.

For this reason, efforts have been made for some time to produce printing plates wherein it is possible to dispense with a wet chemical development process in the production of the image. For this purpose, use can be made of oxide ceramics, which are present, for example, in the form of coatings on a printing plate.

In the published European Patent Document EP 0 911 154 A1, $TiO_2$ and $ZnO_2$ are proposed as a material for the plate surface, and can be present in ceramic form, both pure and with other metallic additives in various mixture ratios. This surface is hydrophobic in the non-energized state and can be changed into a hydrophilic state by irradiation with ultraviolet light. Imaging then takes place, wherein the entire surface of the plate is illuminated with ultraviolet light and areas which are supposed to carry color during printing are covered by a mask and a film, respectively.

In order to be able to produce a color printed image on a printing material, it is necessary to overprint the colors cyan, magenta and yellow and, in order to improve the contrast, also black (CMYK), respectively, onto the printing material, with the aid of a suitable printing form. In particular, in the case of offset printing machines, wherein the respective color is transferred to the printing material in a dedicated inking unit, this procedure requires high register accuracy during the transport of the printing material from one inking unit to the other. This is because only in this way is it possible to avoid undesired register fluctuations leading to a lack of sharpness in the colored image. In such highly precisely operating printing machines, the individual printing units are arranged one after another in an in-line construction, which makes the machine very long. This is all the more so when, in addition to the front, the back is also to be printed, or when additional special colors or varnishes are to be printed onto the printing material. A printing machine of this type is disclosed, for example, in German Patent 42 34 928. In order to counter at least the problem of the extended longitudinal construction of the printing machine, the European Patent 0 512 549 has already proposed a printing machine of so-called satellite construction, wherein the individual inking units are arranged around a central rubber-covered cylinder in the manner of satellites. This certainly reduces the length of the printing machine considerably, but the individual printing inks still have to be applied in individual inking units. Furthermore, it is not possible with this machine to print the back of the printing material, as well.

In addition, U.S. Pat. No. 6,096,386 discloses a stamping printing process wherein, with the aid of a stamp which has elevated and depressed areas, printing ink is transferred from the elevated areas to a printing material. For this purpose, the stamp is provided with a so-called activated surface over the entire surface thereof, i.e., therefore over the elevated and non-elevated areas, the surface then being provided with so-called orientation materials with the aid of a masking process. These orientation materials can be different in the individual mask areas, depending upon the masking. If the stamp is then immersed in a suitable liquid, suitable matching bodies may be arranged on the orientation materials. In order to transfer these matching bodies to a receiving surface, this receiving surface is immersed in a liquid and the printing stamp is pressed onto the receiving surface within this liquid. The matching bodies deposited on the elevated areas of the stamp can therefore be transferred to the receiving surface. The auxiliary liquid, wherein the transfer to the receiving surface takes place, is used for the purpose of providing the stamp surface with orientation materials again immediately after the transfer. This is achieved by the auxiliary liquid having orientation materials added thereto. Following the transfer of the matching bodies to the receiving surface, the receiving surface can be used for the production of an etching mask or a sensor.

SUMMARY OF THE INVENTION

Taken against the background of this prior art, it is an object of the invention to provide a relatively simplified printing process and a related device, which also makes a shorter construction of the printing machine possible.

With the foregoing and other objects in view, there is provided, in accordance with one aspect of the invention, a method for applying printing ink to a printing material, which comprises producing ink-conducting and ink-repelling areas on an at least approximately flat surface; in order to produce the ink-conducting areas on the surface, producing a plurality of areas with defined color acceptor properties; bringing the surface into contact with color particles, including a subgroup selected from the group consisting of dyes, pigments, colored molecules and colored particles, at least one of the subgroups colored molecules and pigments having surface acceptor properties corresponding to the color acceptor properties of the areas; depositing the at least one of the subgroups colored molecules and pigments on the areas of defined color acceptor properties of the surface corresponding to the surface acceptor property thereof; and transferring the deposited at least one of the subgroups colored molecules and pigments from the surface to a printing material.

In accordance with another mode, the method of the invention further comprises providing the at least one of the subgroups colored molecules and pigments as a mixture in a container from which the color particles are transferred to the surface.

In accordance with a further mode, the method of the invention further comprises producing the color acceptor properties on the surface with the aid of electromagnetic radiation.

In accordance with an added mode, the method of the invention further comprises providing the electromagnetic radiation with the aid of a laser.

In accordance with an additional mode, the method of the invention further comprises providing the electromagnetic radiation with the aid of a UV mask.

In accordance with yet another mode, the method of the invention further comprises providing the electromagnetic radiation with the aid of a source of light having a very short wavelength.

In accordance with yet a further mode, the method of the invention further comprises providing the color acceptor properties on the surface as geometric shapes.

In accordance with yet an added mode, the method of the invention further comprises providing the color acceptor properties on the surface as functional chemical groups.

In accordance with yet an additional mode, the method of the invention further comprises producing the color acceptor property on the printing form by at least partial removal of a coating.

In accordance with still another mode, the method of the invention further comprises producing the color acceptor property on the printing form by breaking open capsules.

In accordance with still a further mode, the method of the invention further comprises operating a laser with at least one of a different wavelength and a different pulse intensity in order to produce different color acceptor properties.

In accordance with still an added mode, the method of the invention further comprises applying an electric field in order to produce the color acceptor property on the printing form.

In accordance with still an additional mode, the method of the invention further comprises assisting in the deposition of the colored particles on the printing form by applying a reversible electric field.

In accordance with another aspect of the invention, there is provided a printing form having an at least approximately flat surface, comprising ink-conducting and ink-repelling areas, the ink-conducting areas on the printing form having a respective defined color acceptor property, so that they can bind a color particle which has a surface acceptor property corresponding to the defined color acceptor property.

In accordance with a further feature of the invention, the printing form further comprises thereon various areas with a different color acceptor property, which differ in terms of geometric shape thereof.

In accordance with an added feature of the invention, the printing form further comprises areas with different functional chemical groups serving for producing the defined color acceptor properties.

In accordance with an additional feature of the invention, the printing form further comprises a base layer and at least two layers with functional groups.

In accordance with still another feature of the invention, the printing form further comprises a base layer and at least one further layer having capsules introduced therein, molecules with functional chemical groups for producing a defined color acceptor property being received in the capsules.

In accordance with yet another aspect of the invention, there is provided an inking unit having at least one printing form with an at least approximately flat surface, comprising ink-conducting and ink-repelling areas, the ink-conducting areas on the printing form having a respective defined color acceptor property, so that they can bind a color particle which has a surface acceptor property corresponding to the defined color acceptor property.

In accordance with a concomitant aspect of the invention, there is provided a printing machine with at least one inking unit having at least one printing form with an at least approximately flat surface, comprising ink-conducting and ink-repelling areas, the ink-conducting areas on the printing form having a respective defined color acceptor property, so that they can bind a color particle which has a surface acceptor property corresponding to the defined color acceptor property.

In the method proposed in accordance with the invention, therefore, the surface of a printing form is pretreated in accordance with the printing ink to be applied in the It individual areas of the surface so that these areas are suitable for accepting a specific printing ink. It is therefore possible, with printing inks specifically created for this purpose, for only specific color particles, such as dyes, pigments, colored molecules or colored particles, to be deposited on the correspondingly pretreated areas of the printing form. In practical terms, what is meant thereby is that in the planographic printing process, in particular the offset printing process, under discussion here, in a first method step, the surface of the planographic printing form is pretreated, i.e., therefore marked so that only printing inks corresponding to the marking can be deposited on defined areas. For example, on a single printing form, a marking for cyan, a marking for magenta, one for yellow and one for black can be applied. If the printing form is then brought into contact with a mixture which contains the colored particles cyan, magenta, yellow or black corresponding to the markings, then the colored particles appertaining to the markings are deposited at the corresponding locations on the printing plate and, in a further method step, can be transferred directly or indirectly to the printing material.

Although, with this process, it is possible to discontinue the division of the printing plate in accordance with color separation into individual inking units, heretofore required in planographic printing, in order to improve the resolution or the covering with printing ink, further printing plates and inking units can be provided in a printing machine, respectively, having a specific subset of the information to be printed. This subset can, for one, contain codes divided in accordance with printing inks or mixtures of various codes for various printing inks.

During the production of the codes on the printing form, it is possible, in particular, to treat the printing form with a laser beam and, as a result, to produce geometric codes on the printing form which, in the areas of the printing form identified in this way, permit only those colored particles to be arranged which, in turn, have the corresponding geometric properties. This procedure for encoding the printing form may also be designated a "key-lock principle", a "lock" being applied to the printing form, which can be occupied only by a colored particle having a matching key.

In addition to the geometric encoding of the printing form, it is also possible to use a so-called functional key-lock principle, wherein the areas to be occupied by a specific printing ink on the printing form are occupied by functional groups, for example, functional molecules. In this case, the printing inks corresponding to the codes must, respectively, have the molecules or molecule parts corresponding to the functional molecule. This ensures that selected printing inks are then deposited on the marked area if a colored particle corresponding to the code is brought into contact with the printing form in the area of the code.

The method of printing proposed in accordance with the invention offers the advantage that, opposed to the conventional technology in the planographic printing process, for the first time it becomes possible to accommodate different color separations on a single printing form and, therefore, to reduce considerably the number of inking units required in a printing machine. Therefore, the technical expenditure required for printing is reduced considerably, it being possible at the same time to achieve a reduction in the costs for the printing machine by the omission of inking unit components.

Other features which are considered as characteristic for the invention are set forth in the appended claims.

Although the invention is illustrated and described herein as embodied in a printing method and device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings wherein:

DESCRIPTION OF THE PREFERRED EMBODIMENTS

Figure 1:
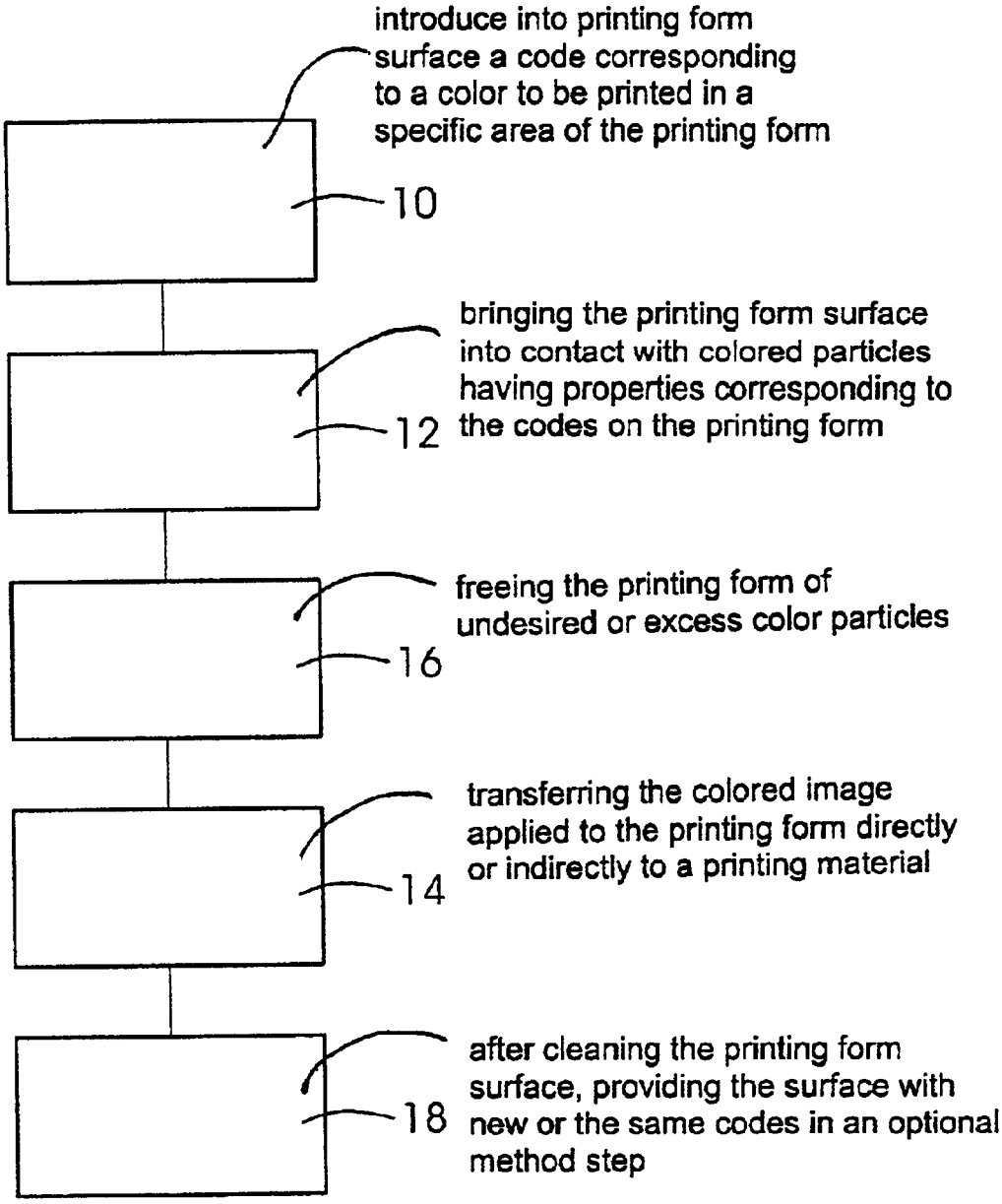
FIG. 1 is a flowchart showing schematically the method according to the invention.

Referring now to the drawings and, first, particularly to FIG. 1 thereof, there is shown therein schematically in a flow chart the method sequence provided in accordance with the invention. In a first method step 10, initially, a code is introduced into a surface of a printing form, the code corresponding to a color to be printed in a specific area of the printing form. A large number of areas with defined color acceptor properties are, therefore, produced on the surface of a printing form. In a further method step 12, the surface of the printing form is then brought into contact with colored particles having properties corresponding to the codes on the printing form, i.e., therefore, the color acceptor properties of the areas applied to the printing form. This makes it possible to deposit specific colored particles encoded in this manner at defined locations on the printing form. In order to bring the printing form into contact with the colored particles, the printing form can, for example, be constructed as a rotating offset printing cylinder, which is also now quite common, the printing cylinder being covered with ink in a conventional inking unit which is already now in use. However, the printing ink used in the inking unit has colored particles which have properties corresponding to the codes applied to the surface of the printing cylinder, so that the individual colored particles can be deposited precisely at the encoded locations on the printing surface. After the desired colored particles have been deposited on the provided areas on the printing form surface, in a further method step 14, the colored image applied to the printing form can be transferred indirectly or directly to a printing material. For the purpose of indirect transfer, the printing image is, for example, initially transferred to a blanket cylinder and from there printed onto the printing material. However, the direct transfer of the printing image to the printing material is also possible. If required, before the method step 14, the printing form surface can be cleaned of undesired colored particles which have not deposited on the codes of the printing form. Before the method step 14, in a further method step 16, the printing form can be freed of undesired or excess color particles, an operation which can preferably be performed with the aid of physical wiping or doctoring. This step may be necessary in particular when the colors are not transported in a conventional inking unit but are transferred to the plate by a dip bath or a spraying technique. Of course, it is also possible, in this regard, to provide the printing form with new or the same codes in an optional method step 18 following the cleaning, in order to be able to continue the printing process with changed information or with the same information.

Figure 2:
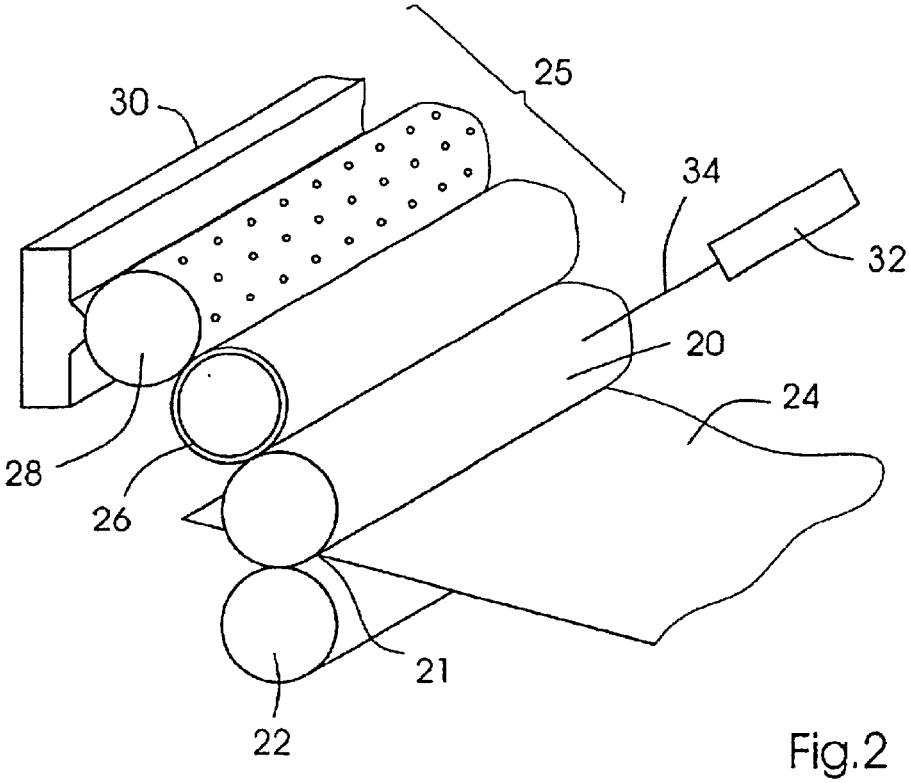
FIG. 2 is a diagrammatic perspective view of the printing device according to the invention, providing a basic representation of printing relating to the production in accordance with the invention of the surface of a printing form with the aid of a laser beam.

FIG. 2 illustrates a basic representation and, for a short inking unit as an example, the use of the printing form according to the invention. In this regard, a printing form cylinder 20 is provided which, together with an impression cylinder 22, forms a printing nip 21, through which the printing material 24, for example, a paper sheet or a paper web, is transported. Also provided is a component 25 for applying the printing ink to the printing form cylinder 20, which, in the example at hand, comprises an applicator roller 26, a screen roller 28 and an ink container 30. From the ink container 30, a mixture of various printing inks, which contains the requisite colored particles, is transferred to the screen roller 28. The colored particles are configured so that they are picked up at the locations on the printing form cylinder which correspond to the applicable color acceptor property thereof. For example, a mixture of the colors cyan, magenta, yellow and black can be provided in the ink container 30, the respective individual colors having different surface acceptor properties assigned thereto, which correspond to the color acceptor properties of the printing form cylinder.

As already shown, in the invention of the instant application, the basic principle of offset printing with hydrophilic and hydrophobic areas as ink-conducting and ink-repelling areas can remain unaffected. Alternatively, however, electrostatic or other forces could also act or could act in a supplementary manner. However, the colored and pigment particles, respectively, are in a common mixture. When this color mixture is brought into contact with an appropriately made-ready printing form 20, the colored particles search in a self-aligning manner for the surface areas corresponding to the surface acceptor properties thereof and having the corresponding color acceptor properties. Expressed in other words, what is meant thereby is that the respective dyes or pigments are deposited on the coded locations allocated thereto on the printing form. As shown in FIG. 2, with the aid of a laser 32 which emits a laser beam 34, the surface of the printing form 20 can be pretreated, inside or outside a printing machine, so that the surface properties corresponding to the colored particles which are used are produced.

Figure 3:
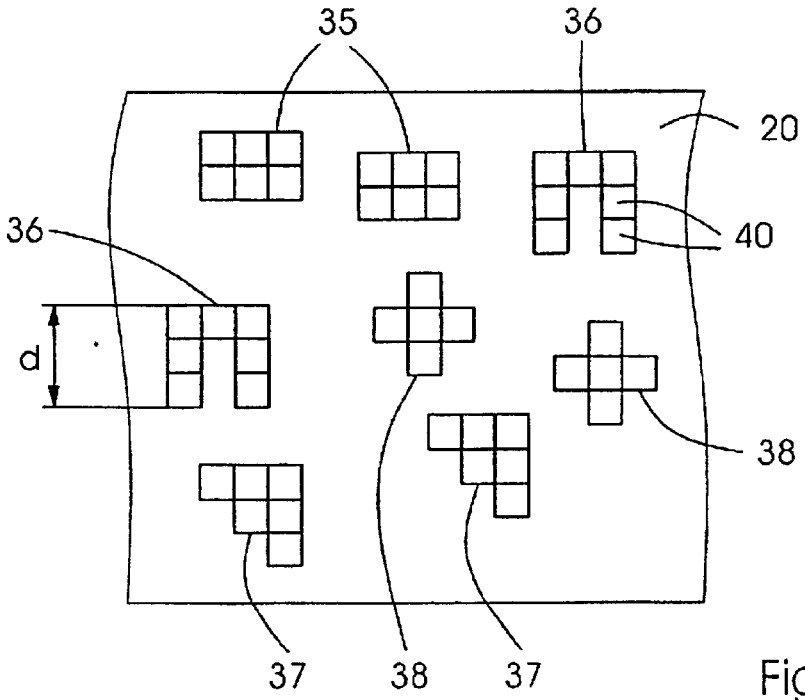
FIG. 3 is an enlarged fragmentary plan view of FIG. 2, showing, in a basic representation, the application of geometric codes or marks to the surface of the printing form.

As is revealed in FIG. 3, for this purpose, for example, a geometric code on the printing form 20 can be used. In this form of encoding, a plurality of codes 35, 36, 37 and 38 is applied to the printing form 20. In this regard, the different codes 35, 36, 37 and 38 represent a respectively different geometric encoding of the printing form 20 which makes it possible for only a specific printing ink, namely that ink corresponding to the respective code 35, 36, 37 and 38, to be deposited at these locations. For example, the code 38 can then represent the color cyan, the code 37 yellow, the code 34 the color magenta and the code 38 black, by which there is meant that only the appropriate dye can be deposited on the respective code thereof. The geometric codes 35, 36, 37 and 38, in turn, are formed for their part of individual points 40, which can be applied with the aid of the laser 32. The characteristic features of the geometric encoding can be formed two-dimensionally or three-dimensionally. In the case of dry offset, forms with a diameter of about 30 micrometers can be realized on the printing plate 20, for example, by using a laser system with 10 $\mu$m resolution. For this purpose, for example, a diode laser with a laser wavelength of 860 nm can be used. Therefore, a resolution of one dot/$\mu$m corresponds to one point on the printing plate and, consequently, about 30 micrometers. Therewith, a resolution of about 600 dpi can be achieved in this way. In FIG. 3, this resolution is identified by the distance d. Of course, it is possible to increase the resolution further in intrinsically desired areas by the introduction of heretofore already known microtechnology using UV or X radiation, for example. Even the possibilities of extremely fine screening are thereby accessible. For the purpose of geometrically encoding the colored particles in a accordance with the invention, use can be made of cyclodextrin molecules, for example. Cyclodextrins are sugar molecules with a characteristic shape and size. Furthermore, they offer the advantage that they are biodegradable, toxicologically unharmful and can be produced on a large industrial scale, cost-effectively and to any desired purity, by enzymatic breakdown of starch.

By forming complex and/or covalent bonds, for example, azo dyes can be deposited and, as a result, the geometrically characteristic molecules can be provided with desired shades of color. Because cyclodextrins have a hydrophobic cavity, this can also be used to deposit colored particles thereon and therein, respectively. In addition to the use as a geometric code molecule on the colored particles, it is likewise conceivable to use cyclodextrins as geometric or functional code molecules in the printing form.

A further class of substances for geometric encoding of colored particles are fiber fragments, complex-forming supramolecule groups or macro molecules of suitable shape and size, whereon the dyes, pigments or other colored particles, for example, the aforedescribed cyclodextrin molecules, are then deposited, reference having to be made here in particular to cyclotriveratrylenes. With these supramolecular components, it is possible to make complex compounds with the pigment particles now being used, so that the production of pigments would barely have to be changed, when compared with conventional colors. In addition, functional groups can be coupled to such supramolecular components, so that the molecules can be produced specifically in accordance with the invention (molecule design).

The technical possibilities stemming from polyelectrolyte capsules with a characteristic geometric shape are very promising. Polyelectrolyte capsules can be functionalized chemically and bound to color-providing groups. They can also be used as dye containers. A quite significant advantage is that polyelectrolyte capsules can be produced in sizes from a few nm to a few hundred $\mu$m. As a result, it is possible to adapt the "color production" to the respective technical approaches in the production of the markings on the printing plate. In particular, the thought here is of different physical resolutions when using different exposure wavelengths.

Figure 4:
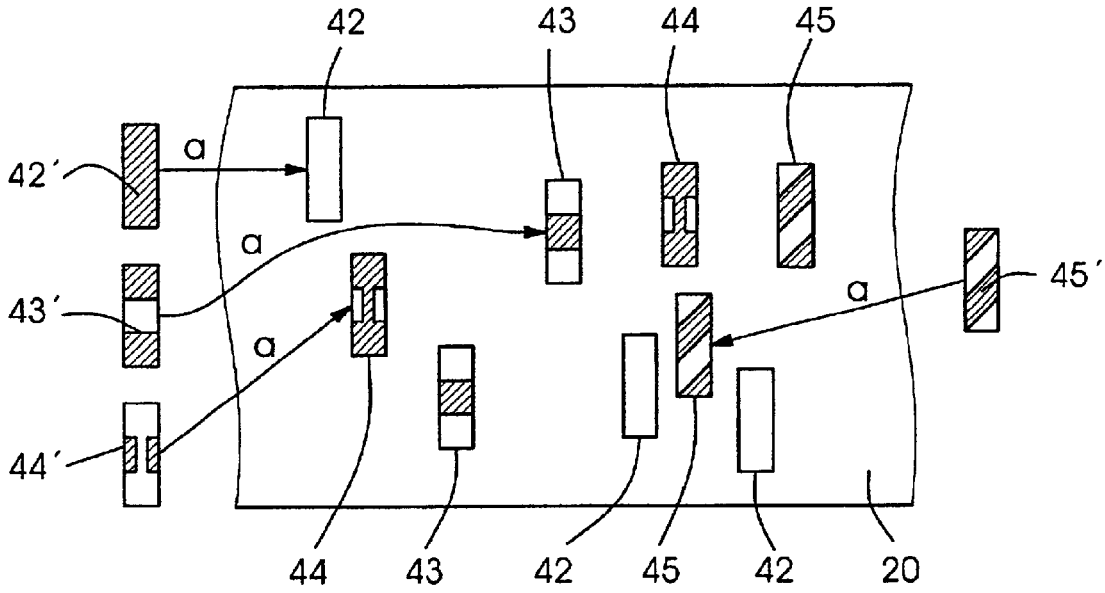
FIG. 4 is a view similar to that of FIG. 3, showing, in a basic representation, the application of functional codes or marks to the printing form surface.

As shown in FIG. 4, however, it is also possible to encode the printing plate 20 functionally, i.e., thus by providing specific chemical groups at specific locations on the printing plate 20. These codes 42, 43, 44 and 45 are different from one another and permit the deposition of dyes or pigments which have the corresponding codes 42', 43', 44' and 45'. FIG. 4 illustrates this deposition possibility by the deposition arrows a. The codes 42, 43, 44 and 45 on the printing plate 20 can be present, for example, as molecular chains with appropriately functional groups, which can be occupied by the corresponding markings of the dyes or pigments 42', 43', 44' and 45'. In the selection of the codes 42, 43, 44 and 45 on the printing plate 20 and the corresponding markings 42', 43', 44' and 45' of the dyes or pigments, recourse can be had, for example, to molecules which exhibit a coupling process that can be viewed as analogous to that of the base sequences in a DNA chain.

Figure 5:
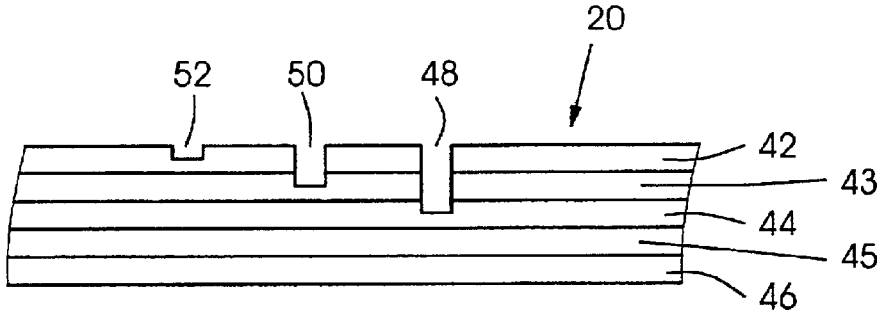
FIG. 5 is a much-enlarged side elevational view of a printing form surface provided with a coating according to the invention for producing the codes or marks.

FIG. 5 shows one possible way of applying the codes to the surface of a printing form 20. In this regard, the printing form is produced in a manner that a plurality of layers, which already contain the respective codes 42, 43, 44 and 45 are applied to a base 46. With the aid of the laser radiation shown in FIG. 2, it is then possible to remove the uppermost layer of the printing form 20 to such an extent that, respectively, the desired code lies on the surface of the printing form. It is thereby possible, at the points 48, 50 and 52, respectively, to deposit different colored molecules which correspond to the code, respectively, present thereat.

Figure 6:
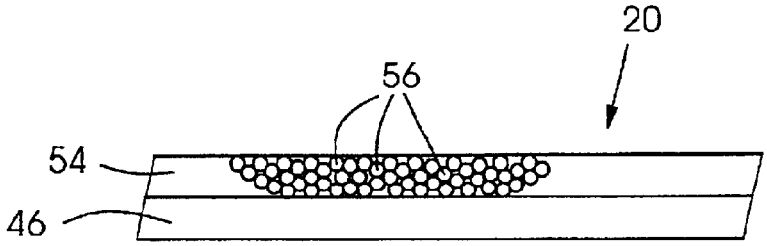
FIG. 6 is a further-enlarged fragmentary side elevational view of FIG. 5 showing a printing form with a coating according to the invention and codes or marks according to the invention lying in the coating.

A further possible way of producing the code on the printing form 20 is shown in FIG. 6. In this case, the printing form 20 is produced in a manner that a further layer 54 is applied to a base 46. This layer 54 contains capsules 56, which lie lined up closely with one another in the layer 54 and which contain the different codes 42, 43, 44 and 45 required for the printing process. In an operation wherein, for example, an electromagnetic radiation such as a laser or an electric field is applied, the capsules 56 can be broken open selectively, so that the code can appear on the surface. Because the codes 42, 43, 44 and 45, respectively, are accommodated in capsules 56 having different properties, in particular, different properties of the wall, it is possible to break open only specific capsules selectively, by controlling the intensity of the laser beam or the wavelength and by controlling the applied field, so that quite specific codes can emerge selectively from the capsules.

If a conventional or a short inking unit is used for the application of ink to the printing plate, the self-alignment of the colored particles on the printing plate is then carried out by repeated splitting and resplitting of the ink layer. In a way analogous to the offset process that is familiar in the present state of the Art, the effective forces which result from the surface energy and the rheology of the ink are adjusted so that no scumming and no "shading" occurs. Consequently, no colored particles can be held on the non-image points, i.e., no scumming occurs, and only the suitable colored particles can be held on the appropriately marked image points, which is referred to as shading.

If alternative techniques are used for the application of ink to the printing plate, such as a dip bath or spraying techniques, the colored particles must not adhere to one another in the printing ink and should be able to diffuse easily at the code locations, in order in this way to ensure self-alignment. The ink should then be as thin as possible. In particular, in a dry offset, therefore, an application with the aid of an ink spray mist may be implemented very well. In a subsequent wiping operation, it is possible to remove the excess ink easily, the forces having to be designed so that the bonding forces to the codes are greater than the wiping force.

In particular, in the case of indirect printing, i.e., in the case of transferring the ink to a rubber blanket, it is possible for problems to occur during the transfer of the ink, for example, due to high capillary forces or excessively high adhesion forces of the colored particles at the code locations. In a further advantageous embodiment of the invention, therefore, electrically chargeable colored particles are used, operations additionally being carried out with a reversible electric field on the printing plate. Consequently, the colored molecules are attracted electrically as they are applied to the plate and are repelled electrically from the plate during the transfer to the rubber blanket when the electric field is reversed.

I claim:

1. A method for applying printing ink to a printing material, which comprises producing ink-conducting and ink-repelling areas on an at least approximately flat surface; producing a plurality of areas with defined color acceptor properties for producing the ink-conducting areas on the surface; bringing the surface into contact with color particles, including a subgroup selected from the group consisting of dyes, pigments, colored molecules and colored particles, at least one of the subgroups colored molecules and pigments having surface acceptor properties corresponding to the color acceptor properties of the areas; providing the at least one of the subgroups colored molecules and pigments as a mixture in a container for transferring the color particles to the surface; depositing the at least one of the subgroups colored molecules and pigments on the areas of defined color acceptor properties of the surface corresponding to the surface acceptor property thereof; and transferring the deposited at least one of the subgroups colored molecules and pigments from the surface to a printing material.

2. The method according to claim 1, which further comprises producing the color acceptor properties on the surface with the aid of electromagnetic radiation.

3. The method according to claim 2, which further comprises providing the electromagnetic radiation with the aid of a laser.

4. The method according to claim 2, which further comprises providing the electromagnetic radiation with the aid of a UV mask.

5. The method according to claim 2, which further comprises providing the electromagnetic radiation with the aid of a source of light having a very short wavelength.

6. The method according to claim 1, which further comprises providing the color acceptor properties on the surface as geometric shapes.

7. The method according to claim 1, which further comprises providing the color acceptor properties on the surface as functional chemical groups.

8. The method according to claim 7, which further comprises producing the color acceptor property on a printing form by at least partial removal of a coating.

9. The method according to claim 7, which further comprises producing the color acceptor property on a printing form by breaking open capsules.

10. The method according to claim 7, which further comprises operating a laser with at least one of a different wavelength and a different pulse intensity in order to produce different color acceptor properties.

11. The method according to claim 7, which further comprises applying an electric field in order to produce the color acceptor property on a printing form.

12. The method according to claim 1, which further comprises assisting in the deposition of the colored particles on a printing form by applying a reversible electric field.

* * * * *